US009752785B2

(12) United States Patent
Corleoni

(10) Patent No.: US 9,752,785 B2
(45) Date of Patent: Sep. 5, 2017

(54) SENSOR UNIT FOR A SUCTION HOOD, SUCTION HOOD AND COOKING DEVICE

(75) Inventor: Francesco Corleoni, Meldola (IT)

(73) Assignee: Electrolux Home Products Corporation N. V., Brussels (BE)

( * ) Notice: Subject to any disclaimer, the term of this patent is extended or adjusted under 35 U.S.C. 154(b) by 1058 days.

(21) Appl. No.: 13/318,234

(22) PCT Filed: Jun. 9, 2010

(86) PCT No.: PCT/EP2010/003440

§ 371 (c)(1),
(2), (4) Date: Oct. 31, 2011

(87) PCT Pub. No.: WO2010/142425

PCT Pub. Date: Dec. 16, 2010

(65) Prior Publication Data

US 2012/0111314 A1 May 10, 2012

(30) Foreign Application Priority Data

Jun. 12, 2009 (EP) ..... 09007738

(51) Int. Cl.
*F24C 15/20* (2006.01)

(52) U.S. Cl.
CPC ..... *F24C 15/2021* (2013.01)

(58) Field of Classification Search
USPC ..... 126/299 D, 299 R; 454/49, 67; 96/397, 96/399, 407
See application file for complete search history.

(56) References Cited

U.S. PATENT DOCUMENTS

| | | | | |
|---|---|---|---|---|
| 5,163,234 | A * | 11/1992 | Tsukamoto et al. | 34/487 |
| 5,372,545 | A * | 12/1994 | Noda et al. | 454/256 |
| 5,690,093 | A * | 11/1997 | Schrank et al. | 126/299 D |
| 6,142,142 | A | 11/2000 | Woodall | |
| 6,920,874 | B1 | 7/2005 | Siegel | |
| 7,699,051 | B2 * | 4/2010 | Gagas et al. | 126/299 D |
| 7,823,227 | B2 * | 11/2010 | Damianoe et al. | 4/213 |
| 8,511,578 | B2 * | 8/2013 | Has | 236/45 |
| 2002/0129809 | A1 * | 9/2002 | Liese | 126/299 R |
| 2005/0150387 | A1 * | 7/2005 | Has | 96/407 |
| 2005/0224069 | A1 * | 10/2005 | Patil et al. | 126/299 D |
| 2006/0254430 | A1 * | 11/2006 | Nevarez et al. | 99/349 |
| 2007/0023420 | A1 * | 2/2007 | Gagas | 219/623 |

(Continued)

FOREIGN PATENT DOCUMENTS

| | | |
|---|---|---|
| DE | 2518750 | 11/1976 |
| DE | 7633882 | 2/1977 |

(Continued)

OTHER PUBLICATIONS

International Search Report for PCT/EP2010/003440, dated Oct. 25, 2010, 3 pages.

*Primary Examiner* — Jason Lau
(74) *Attorney, Agent, or Firm* — Pearne & Gordon, LLP

(57) ABSTRACT

The invention relates to a sensor unit (2) for a suction hood (1), wherein the sensor unit (2) controls the suction hood (1), wherein the sensor unit (2) comprises a, preferably first, sensor operated mode, wherein the operation of the suction hood (1) is dependent on the measured values of at least one sensor (21, 22) and to a suction hood with a sensor unit according to the invention.

14 Claims, 1 Drawing Sheet

(56) References Cited

U.S. PATENT DOCUMENTS

Figure 1:
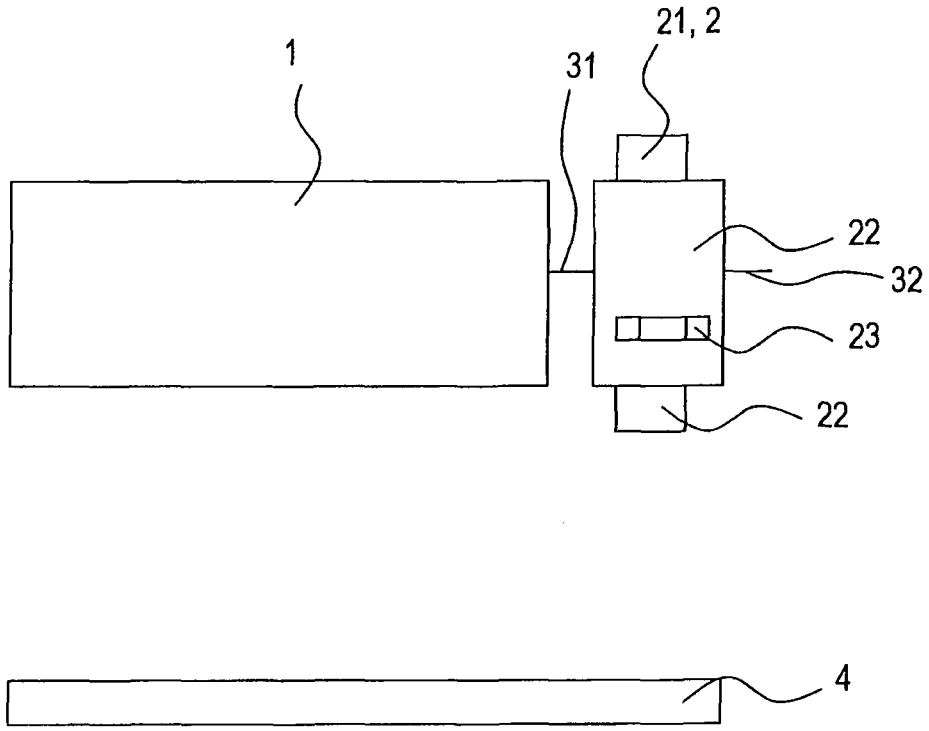

| | | | | |
|---|---|---|---|---|
| 2007/0245617 | A1* | 10/2007 | Deibert | 43/72 |
| 2010/0089240 | A1* | 4/2010 | Krichtafovitch | 96/32 |
| 2010/0163549 | A1* | 7/2010 | Gagas et al. | 219/622 |
| 2011/0251733 | A1* | 10/2011 | Atkinson et al. | 700/300 |

FOREIGN PATENT DOCUMENTS

| | | |
|---|---|---|
| DE | 3401335 | 7/1985 |
| DE | 3909125 | 9/1990 |
| EP | 1039235 | 9/2000 |
| EP | 1450106 | 8/2004 |
| WO | 2008057262 | 5/2008 |

* cited by examiner

SENSOR UNIT FOR A SUCTION HOOD, SUCTION HOOD AND COOKING DEVICE

The invention relates to a sensor unit and a suction hood, especially for use in kitchens, and a cooking device.

Suction hoods, which use a sensor element for controlling the suction hood, are basically known from DE 30 39 246 A1.

Common suction hoods need a lot of energy for operation. On the one hand, these suction hoods consume at least relatively much electrical energy for operating the suction hood and, on the other hand, an at least relatively high amount of warm indoor air is blown outside which cools down the room, especially during the winter time, and therefore has to be replaced by heating up the indoor air again.

Therefore, it is an object of the invention to minimize the amount of consumed energy and preferably to improve the functionality of the suction hood and/or to simplify the assembling of the hood.

Furthermore, it is desirable to improve also the behaviour of a conventional suction hood.

According to claim 1, the invention relates to a sensor unit for a suction hood, wherein the sensor unit controls or can control the suction hood, wherein the sensor unit comprises a) a, preferably first, sensor operated mode, wherein the operation of the suction hood is dependent on the measured values of at least one sensor and b) preferably a second mode, wherein the suction hood is turned off or wherein the sensor operated mode is deactivated, c) preferably a third, conventional mode, wherein the suction hood is continuously turned on.

Furthermore, the invention relates to a suction hood with a sensor unit according to the invention.

The at least one sensor can preferably be activated by fumes, by the temperature of fumes, and/or by the concentration of certain gases, for example $CO_2$. This allows an energy efficient operation of the suction hood, as the suction hood is operated only as much and as long as needed. For example, a gas cooking oven produces CO and $CO_2$ when it is turned on. Also, from cooking, an increased amount of exhaust gases like CO and $CO_2$ can be generated, which can be detected by the sensor.

Preferably, the at least one sensor can be activated by nearness or proximity of an object, especially a cooking vessel or pot. An example for such a sensor is a sonar distance sensor. Especially, but not only in this case, a processing unit can be used which activates the suction hood after the sensed value exceeds a threshold value for a predefined time span, for example 20 seconds.

Preferably, the at least one sensor can be activated by chemical substances, especially smells. Especially, an electronic nose can be used which preferably is able to find the main chemical compound which generates the smell.

Preferably, the at least one sensor can be activated by magnetic fields. This activation method is preferably used in combination with induction cooking devices, but can also be used in combination with other cooking devices, like electric cooking devices.

Preferably, the at least one sensor can be activated by light. This activation method is preferably used in combination with gas cooking devices, but can also be used in combination with other cooking devices, like electric and/or induction cooking devices.

In the sensor operated mode, the sensor unit preferably measures actual values and the suction hood is turned on, when the measured value rises above a first value, and turned off, when the measured value falls below a second value. Preferably, the first value is lower or higher than the second value or equal to the second value.

Preferably, the suction volume of the suction hood depends on the level of the values measured by the sensor unit. In this case, for example, a very high amount of fumes can result in a higher speed of the fan which operates the suction hood.

Preferably, the suction hood comprises means, especially a fan, for sucking air with different suction volumes, wherein at least for one suction volume, a change in the suction volume of the suction hood is at least substantially proportional, reciprocal or in an exponential dependency to a change of the measured value.

In an advantageous embodiment, the sensor unit comprises a switching unit which determines the working mode of the suction hood, wherein especially the type of measured values can be selected. For example, it can preferably be selected, whether only fumes or also $CO_2$ shall activate the suction hood.

The sensor unit can be attached to the suction hood, preferably besides the suction hood and/or can have a first sensor on the lower surface and the second sensor on the upper surface.

Preferably, the suction volume of the suction hood is determined by a comparison of the measured values of the first sensor and the second sensor.

The sensor unit is preferably used as a control unit which is connected to the suction hood by at least one cable, wherein the at least one cable preferably transmits the desired suction volume, wherein preferably the transmitted voltage or current value or signal indicates the desired suction volume.

The suction hood is preferably mounted above a cooking appliance, preferably above a cooking hob or an oven.

Furthermore, the invention relates to a cooking device with a suction hood according the invention, wherein the cooking device is preferably a gas cooking device and/or induction cooking device and/or electric cooking device and/or wherein the cooking device especially comprises a cooking hob, preferably a glass ceramic hob and/or an oven and/or wherein the suction hood is controllable by the cooking device in a contactless way, especially the by usage of the sensor unit.

Furthermore, the invention relates to the attachment of a sensor unit according to the invention to an existing suction hood. This can be achieved, for example, by switching the sensor unit into the power supply of the suction hood.

Figure 2:
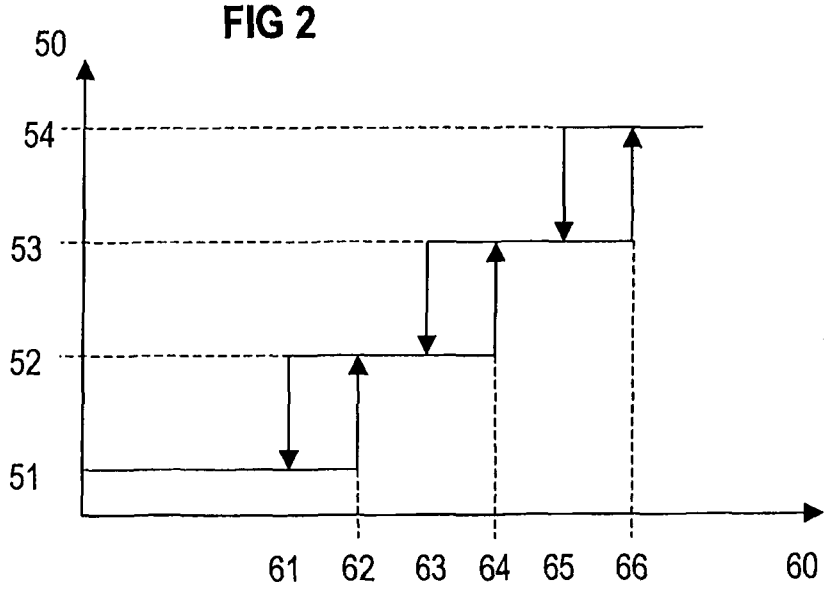

The invention will now be described in further details with references to the schematical drawings in which FIG. 1 shows an embodiment with a sensor unit according to the invention and in which FIG. 2 shows the correlation between gas concentration and suction volume.

A suction hood 1 is mounted above a hob or oven 4. Besides the suction hood 1, a sensor unit 2 is mounted. The sensor unit 2 comprises a first sensor 21 mounted on top of the sensor unit 2 and a second sensor 22 mounted on the bottom of the sensor unit 2. The sensor unit 2 is connected with the suction hood 1 via a cable 31 and, with the power supply, by a cable 32. The sensor unit 2, furthermore, comprises a switch 23 which has on OFF-position, a sensor operated position, wherein the operation of the suction hood 1 is dependent on the measured values of the sensors 21 and 22, and an ON position, wherein the suction hood 1 is continuously turned on. The switch can also have positions which indicate, which values shall be detected by the sensors. The sensor unit 2 can be activated in different ways. These different alternatives can be implemented as different embodiments, wherein one embodiment can comprise either one of the described alternatives or a combination of several alternatives.

As a first alternative, the sensor unit 2 can be activated by fumes, by the temperature of fumes, and/or by the concentration of certain gases, for example $CO_2$. This allows an energy efficient operation of the suction hood, as the suction hood is operated only as much and as long as needed. For example, a gas cooking oven produces CO and $CO_2$ when it is turned on. Also, from cooking, an increased amount of exhaust gases like CO and $CO_2$ can be generated, which can be detected by the sensor.

As a second alternative, the sensor unit 2 can be activated by nearness or proximity of an object, especially a cooking vessel or pot. An example for such a sensor is a sonar distance sensor. Especially, but not only in this case, a processing unit can be used which activates the suction hood after the sensed value exceeds a threshold value for a predefined time span, for example 20 seconds.

As a third alternative, the sensor unit 2 can be activated by chemical substances, especially smells. Especially, an electronic nose can be used which preferably is able to find main chemical compound which generates the smell.

As a fourth alternative, the sensor unit 2 can be activated by magnetic fields. This activation method is preferably used in combination with induction cooking devices, but can also be used in combination with other cooking devices, like electric cooking devices.

As a fifth alternative, the sensor unit 2 can be activated by light, especially light intensity. This activation method is preferably used in combination with gas cooking devices, but can also be used in combination with other cooking devices, like electric and/or induction cooking devices.

When a first predetermined value or higher is measured by the sensor unit 2 and the switch 32 is in the sensor operated position, the suction hood 1 is switched on. When a predetermined second predetermined value which can be higher or lower than the first predetermined value is measured by the sensor, the suction hood 1 is switched off.

The suction volume of the suction hood 1 depends on the level of the measured value of the sensors 21 and 22.

At least for one suction volume, a change in the suction volume of the suction hood is at least substantially proportional, reciprocal or in an exponential dependency to a change of the measured value.

Therefore, the user does not have to think about the hood, it can be started automatically every time a cooking process is starting. The hood is independent from other household appliances and only dependent on the cooking process.

The suction hood 1 can be activated by fumes, by the temperature of the fume, and/or by the concentration of certain gases, for example $CO_2$.

FIG. 2 shows the correlation between the concentration of the gas concentration 60 or, in general, the level of the sensed value, measured by the at least one sensor and the suction volume 50 of the suction hood 1, which is dependent on the rotation speed of the fan. Depending on the concentration 60 of the measured gas or the level of the sensed value, the suction hood 1 will suck with volume 51 to 54 wherein 51 means no suction and 54 means the highest suction volume. When a gas concentration or a level 62 is exceeded, the suction hood 1 will suck with suction volume 52. When a gas concentration or a level 64 is exceeded, the suction hood 1 will suck with suction volume 53. When a gas concentration or a level 66 is exceeded, the suction hood will suck with suction volume 53.

However, for reducing the suction volume, a lower gas concentration or a lower level 61, 63, 65 must be present.

The sensor unit 2 can be mounted to an existing suction hood 1. To achieve this, the sensor unit 2 is switched into the power supply 31 of the suction hood 1.

The suction hood 1 is mounted above a cooking device 4, which can be a gas cooking device and/or an induction cooking device and/or an electric cooking device. The cooking device can comprise a cooking hob, preferably a glass ceramic hob and/or an oven.

The suction hood 1 is controllable by the cooking device 4 in a contactless way by the usage of the sensor unit.

The sensor unit 2 can be attached to an existing suction hood by switching the sensor unit 2 into the power supply of the suction hood 1.

REFERENCE SIGNS

1 suction hood
2 sensor unit
21 first sensor
22 second sensor
23 switch
31, 32 cables
4 hob or oven
50-54 suction volumes
60-66 gas concentrations

The invention claimed is:

1. Sensor unit (2) for a suction hood (1), wherein the sensor unit (2) controls or can control the suction hood (1), wherein the sensor unit (2) comprises a sensor operated mode, wherein an operation of the suction hood (1) is dependent on a measured value of at least one sensor (21, 22)

wherein the at least one sensor includes a sonar distance sensor activated by proximity of a cooking vessel, and a processing unit activates the suction hood after the measured value from the sonar distance sensor exceeds a threshold value for a predefined time span.

2. Sensor unit according to claim 1, wherein the sensor unit (2) comprises a) a second mode, wherein the suction hood (1) is turned off or wherein the sensor operated mode is deactivated and b) a third, conventional mode, wherein the suction hood (1) is continuously turned on.

3. Sensor unit according to claim 1, a) wherein the at least one sensor (21, 22) includes a sensor activated by fumes, by the temperature of fumes, and/or by the concentration of certain gases.

4. Sensor unit according to claim 1, a) wherein the at least one sensor (21, 22) includes a sensor activated by chemical substances, including smells and/or b) wherein the at least one sensor (21, 22) includes a sensor activated by magnetic fields.

5. Sensor unit according to claim 1, wherein the at least one sensor (21, 22) includes a sensor activated by light.

6. Sensor unit according to claim 1, wherein the threshold value is a first threshold value, and a) wherein in the sensor operated mode, the sensor unit (2) measures actual values and the suction hood (1) is turned on, when the measured value rises above the first threshold value (62), and turned off, when the measured value falls below a second threshold value (61), wherein b) the first threshold value is lower or higher than the second threshold value or equal to the second threshold value.

7. Sensor unit according to claim 1, wherein the sensor unit (2) comprises a switching unit (23) which determines a working mode of the suction hood (1), wherein a type of measured values can be selected.

8. Suction hood with a sensor unit (2) according to claim 1.

9. Suction hood according to claim 8, a) wherein the suction hood (1) comprises a fan, for sucking air with different suction volumes, b) wherein the suction volume of the suction hood (1) depends on a level of the values measured by the sensor unit (2), c) wherein, at least for one suction volume, a change in the suction volume of the suction hood (1) is at least substantially proportional, reciprocal or in an exponential dependency to a change of the measured value.

10. Suction hood according to claim 8, a) wherein the sensor unit (2) is used as a control unit which is connected to the suction hood (1) by at least one cable (31), b) wherein the at least one cable (31) transmits a signal indicative of a desired suction volume.

11. Suction hood according to claim 8, wherein the suction hood (1) is mounted above a cooking appliance (4).

12. A cooking device with a suction hood according to claim 1, a) wherein the cooking device is a gas cooking device and/or induction cooking device and/or electric cooking device and/or b) wherein the cooking device comprises a cooking hob and/or an oven and/or c) wherein the suction hood is controllable by the cooking device in a contactless way, by the usage of the sensor unit (2).

13. Attachment of a sensor unit (2) according to claim 1 to an existing suction hood (1).

14. A cooking system, comprising:

an induction cooking device comprising a glass ceramic cooking hob; and a suction hood comprising a sensor unit, wherein the sensor unit controls or can control the suction hood, the sensor unit comprising a sensor operated mode, wherein an operation of the suction hood is dependent on a measured value of at least one sensor, and wherein the sensor unit is activated by magnetic fields, wherein the sensor unit comprises a switching unit which determines a working mode of the suction hood, wherein a type of measured values measured by the sensor unit can be selected.

* * * * *